US005245713A

United States Patent [19]

Tickle

[11] Patent Number: 5,245,713

[45] Date of Patent: Sep. 21, 1993

[54] HAIR WASHING UNIT

[76] Inventor: Edwin J. Tickle, 104-530 Daer Blvd., Winnipeg, Manitoba, Canada, R3K 1C5

[21] Appl. No.: 720,594

[22] Filed: Jun. 25, 1991

[30] Foreign Application Priority Data

Jun. 27, 1990 [CA] Canada ..... 2019938

[51] Int. Cl.[5] ..... A45D 19/10

[52] U.S. Cl. ..... 4/516; 4/519; 4/523; 4/625

[58] Field of Search ..... 4/515, 516, 517, 518, 4/519, 520, 521, 522, 523, 625; D28/20, 9; D23/307, 308, 287, 289, 303; 206/563, 564, 486, 490, 427; 220/628, 635, 623; 4/515-523, 625; 4/515-523, 625

[56] References Cited

U.S. PATENT DOCUMENTS

| | | | |
|---|---|---|---|
| D. 135,579 | 4/1943 | Pientkewic | D28/20 |
| D. 319,687 | 9/1991 | Kohler, Jr. et al. | D23/287 |
| 1,361,887 | 12/1920 | Mattison | 4/519 |
| 2,425,513 | 8/1947 | Czajcinski et al. | 4/515 |
| 3,068,491 | 12/1962 | Perkekrestenko | 4/516 |
| 3,449,771 | 6/1969 | Watson | 4/515 |
| 3,453,665 | 7/1969 | Cokic et al. | 4/625 |
| 3,465,370 | 9/1969 | Chernick | 4/515 |
| 3,579,656 | 5/1971 | Guarrasi | 4/519 |
| 3,694,826 | 10/1972 | Pugh | 4/515 |
| 3,733,620 | 5/1973 | Glintz | 4/515 |
| 4,068,760 | 1/1978 | Johnson, Jr. | 206/563 X |
| 4,419,774 | 12/1983 | Hajek | 4/516 |
| 4,512,043 | 4/1985 | Nolan | 4/523 X |
| 4,651,361 | 3/1987 | Nolan | 4/516 |
| 4,771,487 | 9/1988 | Little | 4/519 |

FOREIGN PATENT DOCUMENTS

| | | | |
|---|---|---|---|
| 0580134 | of 1958 | Italy | 4/518 |
| 1225873 | 3/1971 | United Kingdom | 4/519 |

*Primary Examiner*—William A. Cuchlinski, Jr.
*Assistant Examiner*—John L. Beres
*Attorney, Agent, or Firm*—Larson and Taylor

[57] ABSTRACT

A hair washing unit for washing the hair of bedridden patients is formed as a unitary, hollow, rotationally moulded shell. The shell has a peripheral wall surrounding a central recessed well. A U-shaped depression in a front part of the wall merges smoothly into a shoulder support ramp sloping outwardly from the front of the unit to support the shoulder and neck area of a person whose hair is being washed. A drain opening from the well into the shell interior provides for waste water storage and transportation within the shell, while a second drain from the shell provides for disposal of the waste water.

8 Claims, 5 Drawing Sheets

HAIR WASHING UNIT

FIELD OF THE INVENTION

The present invention relates to a hair washing unit and more particularly to a unit useful in washing the hair of a person confined to bed.

BACKGROUND

It is extremely difficult to wash the hair of a recumbent, bedridden person. The process is both awkward for the person washing the hair and uncomfortable to the person whose hair is being washed. Various washing units have been proposed to assist in performing this task. Many of these are bulky, awkward to handle and complex in their construction. The known units are generally uncomfortable in use because the neck is supported on a narrow, elevated wall, with the head tipped back on the side of the wall and the shoulders supported off the bed on the other. The wall is necessary however, to confine the wash water in a wash basin.

The present invention is therefore concerned with provision of an improved hair washing unit especially for bedridden persons.

SUMMARY

According to the present invention there is provided a hair washing unit comprising a unitary, hollow shell having a peripheral wall surrounding a well recessed into a top surface of the unit, a U-shaped depression in a front portion of the peripheral wall, and a shoulder support ramp sloping outwardly away from the front portion of the peripheral wall and merging into the depression.

This configuration of the device is simple in construction. It can readily be manufactured using a rotational moulding technique. The resultant unit is light in weight and readily manipulated. The moulded in shoulder ramp raises and supports the shoulders and the neck, providing a marked improvement in comfort during use. The unit is preferably moulded from the polypropylene, which is strong and therefore safe material in terms of its physical properties. In addition, a unit of linear low-density polyethylene (LLDPE) is autoclavable so that it can be used when treating head injuries.

The preferred embodiment of the unit has a well drain for draining wash and rinse water from the well into the hollow shell. A shell drain is used for draining the liquid collected in the shell.

BRIEF DESCRIPTION OF THE DRAWINGS

In the. accompanying drawings, which illustrate an exemplary embodiment of the present invention.

DETAILED DESCRIPTION

Figure 1:
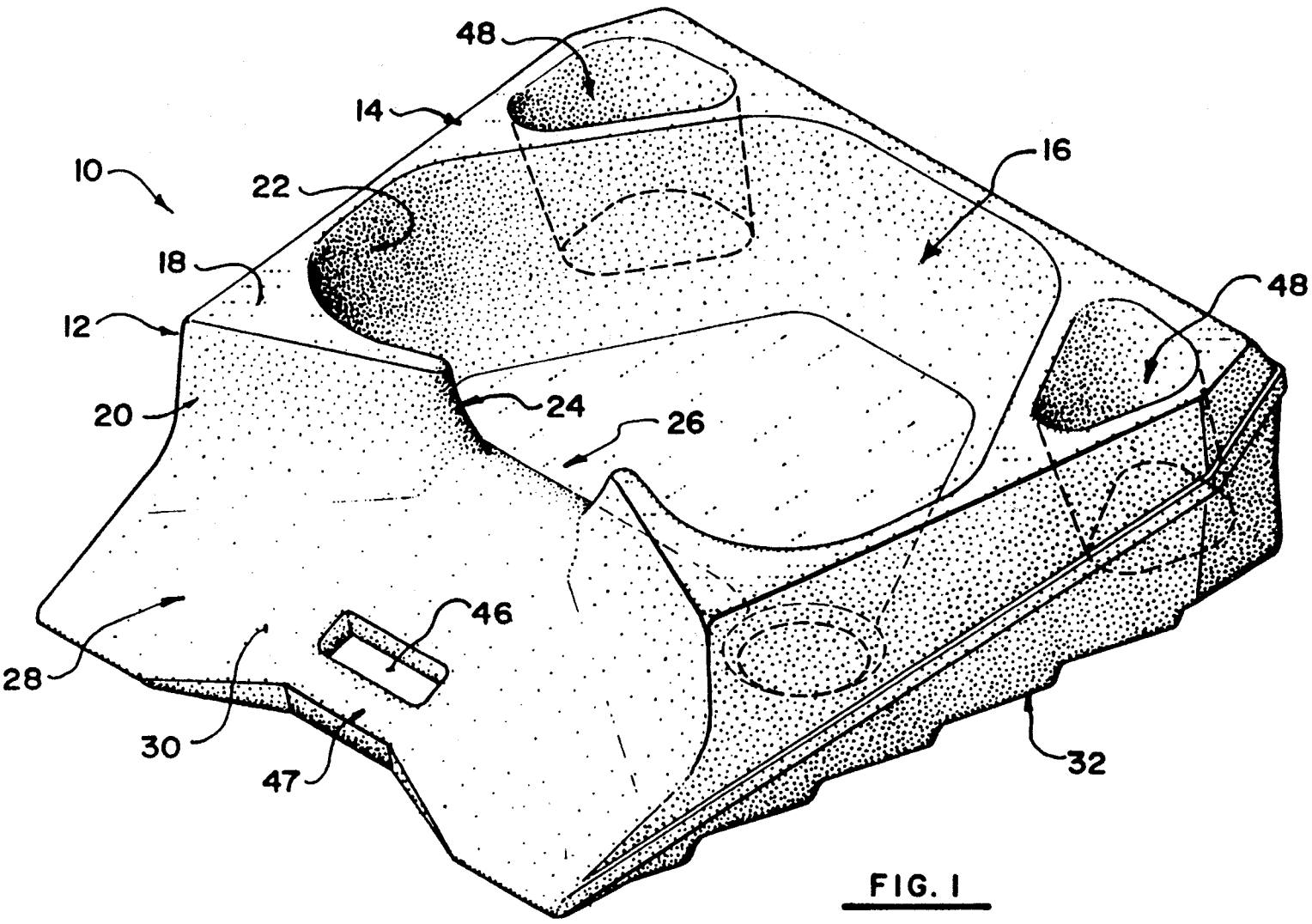
FIG. 1 is a perspective view of the hair washing unit.
Figure 2:
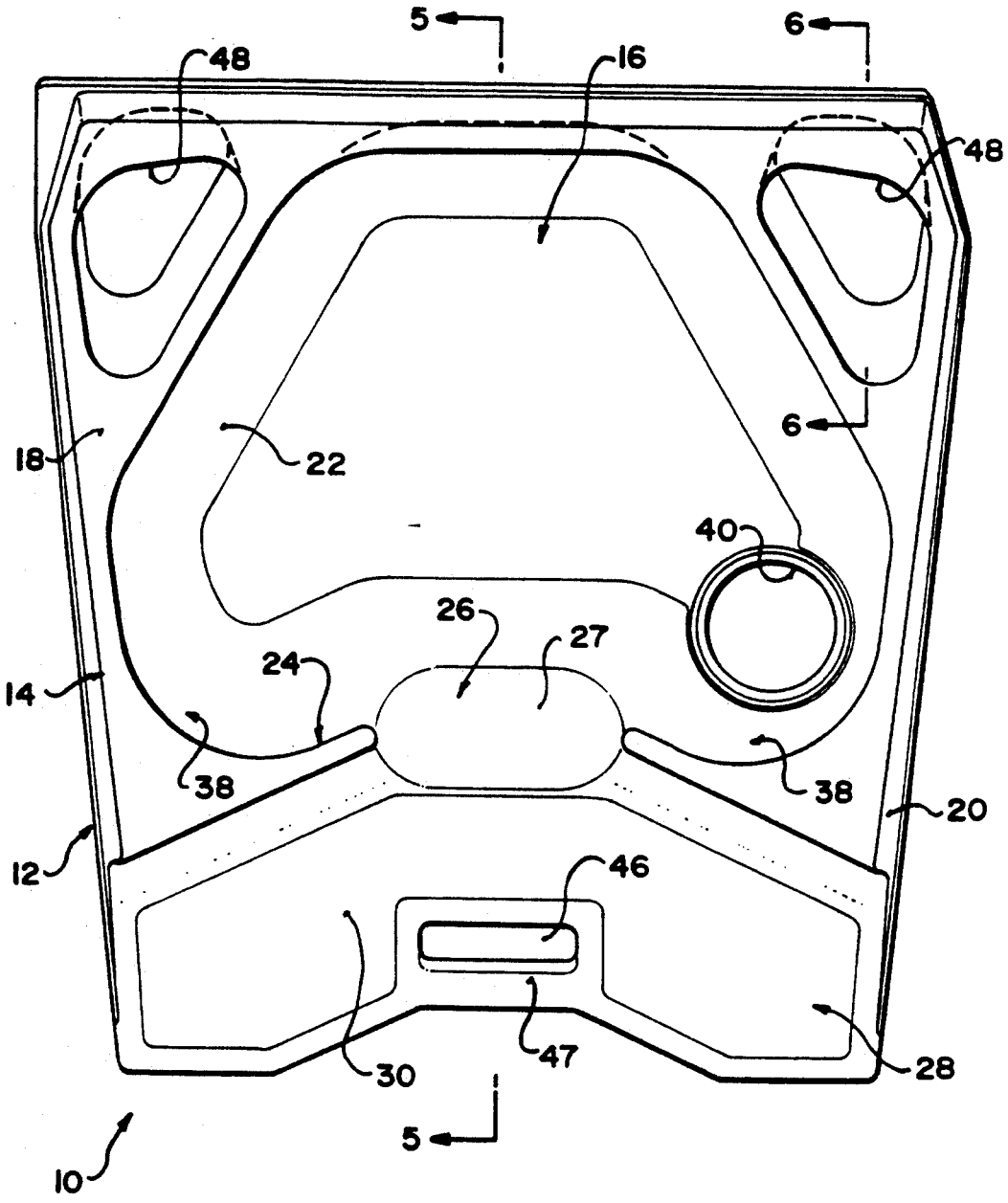
FIG. 2 is a plan view of the hair washing unit.
Figure 3:
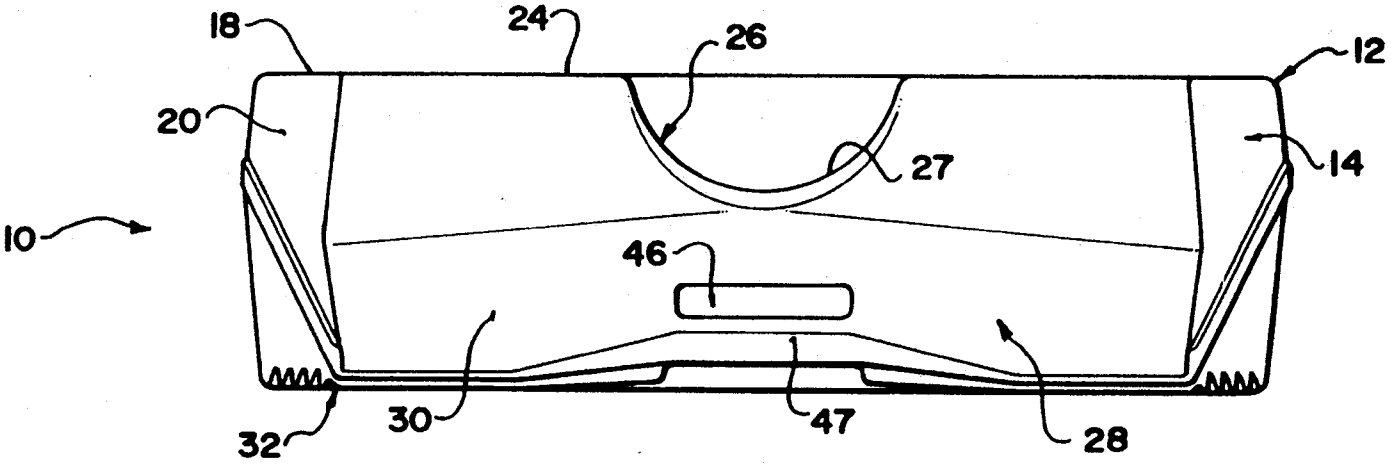
FIG. 3 is a front elevation of the unit.

Referring to the drawings, there is illustrated a hair washing unit 10 that consists of a hollow shell 12 rotationally moulded of linear low-density polyethylene.

The shell has a peripheral wall 14 surrounding a central oval well or basin 16.

The wall 14 has a top panel 18 that slopes downwardly from the outside of the wall to the inside. The wall is bounded on the outside and inside by an outer panel 20 and an inner panel 22.

The wall 14 includes a front section 24 that has a central, U-shaped neck depression 26. Leading from the front section 24 of wall 14 is a shoulder ramp 28 that includes a panel 30 that slopes outwardly away from the outer panel 20 of the wall front section 24. The panel 30 merges at its upper end into the panel 20 and the depression 26.

Figure 4:
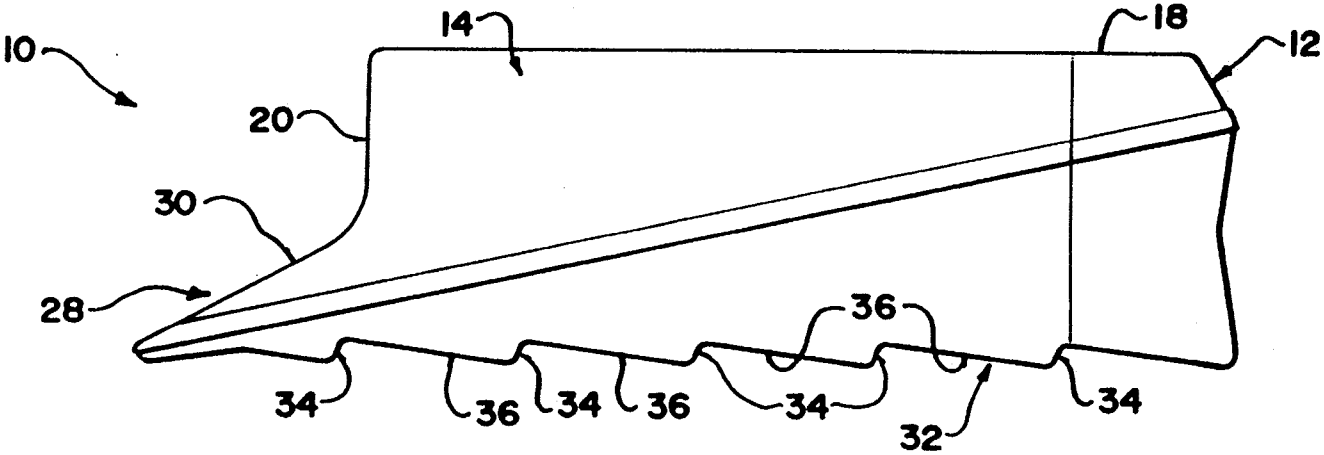
FIG. 4 is a side elevation of the unit.
Figure 5:
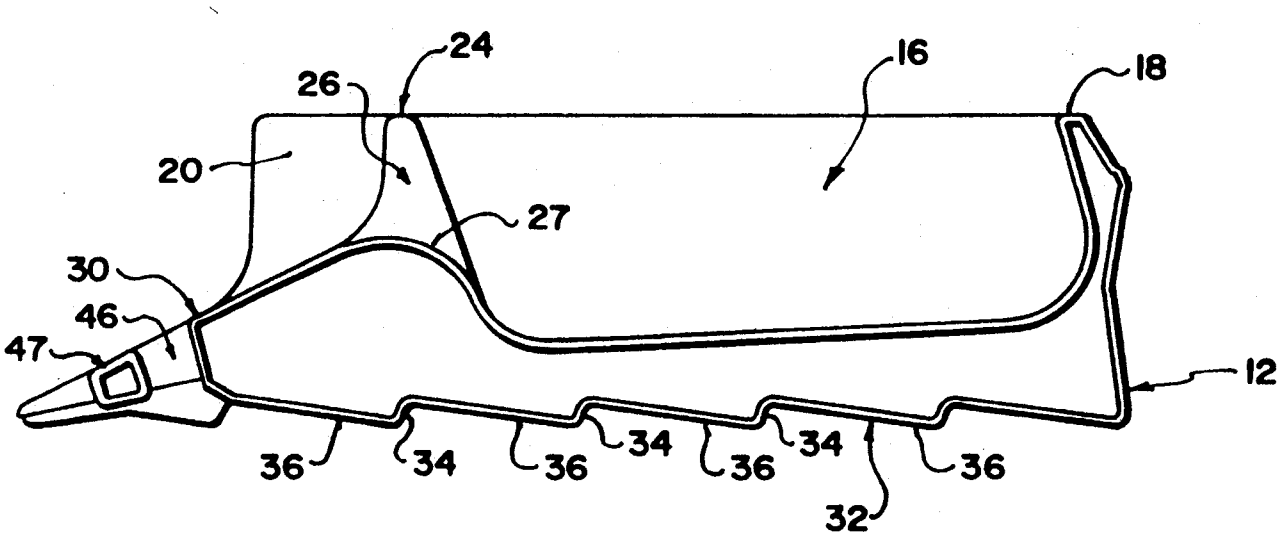
FIG. 5 is a sectional view along line 5—5 of FIG. 2.

The shell is completed with a stepped base panel 32. As illustrated in FIGS. 4 and 5, the base is a series of short rearwardly directed steps 34 interrupted by an upwardly and forwardly sloping panels 36. The steps extend from side to side of the unit. These act to inhibit sliding of the unit when in use.

The well 16 is formed with side lobes 38 at the front, on opposite sides of the neck depression 26. The outline of the well and the portions of the front wall section 24 on opposite sides of the depression 26 then converge towards the rear from the side lobes, giving the well an overall generally triangular outline.

In the base of one of the lobes is a drain opening 40 that leads from the well into the interior of the hollow shell 12. The drain opening is closed by a valve 42 that will be described in more detail in the following. The floor of the well slopes towards the drain opening to assist in complete drainage of liquid from the well into the shell.

The shell is equipped with a drain 44 adjacent one rear corner of the shell. The drain has a valve fitting 45 that is normally closed and can be opened as desired to allow water in the shell to be drained.

Along the front of the shell is an elongate through opening 46 that provides a hand grip 47 along the front edge for carrying the unit.

Figure 6:
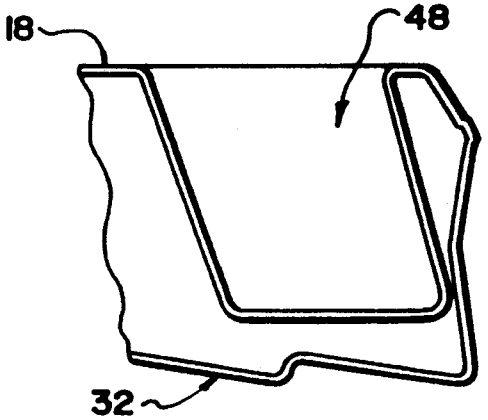
FIG. 6 is a sectional view along line 6—6 of FIG. 2.

At the rear corners of the top panel 18 are triangular wells 48 for holding bottles of shampoo or other hair treatment materials. As illustrated most particularly in FIG. 6, the wells 48 slope towards the front of the unit. This particular configuration of the well has been found effective in housing hair care product bottles of most shapes and retains them securely whether the unit is the horizontal, in-use position or in a vertical position, suspended by the hand grip 47. As will be noted from FIG. 6, the base of each well 48 is generally horizontal, that is parallel to a plane containing the basis of the steps 34 in the base panel 32.

Figure 8:
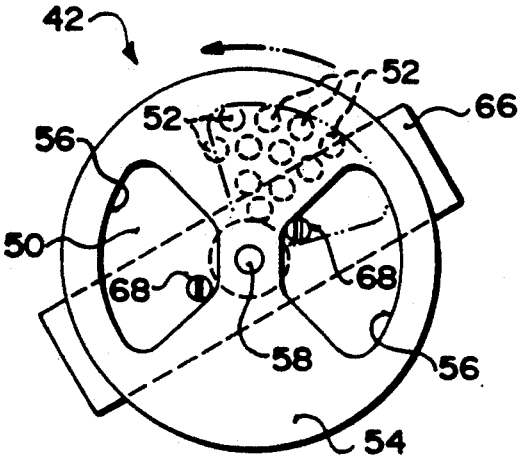
FIG. 8 is a plan view of a well drain.
Figure 9:
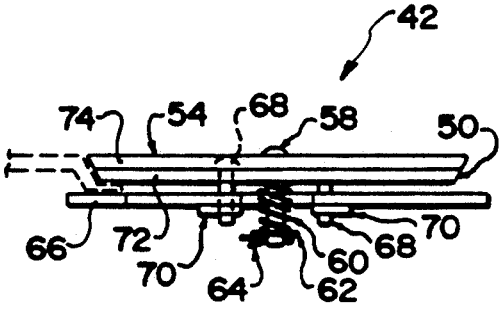
FIG. 9 is an elevation of the well drain.

The configuration of the drain valve 42 from the well is illustrated most particularly in FIGS. 8 and 9. The valve includes a circular drain plate 50 with one segment having a series of drain openings 52. These are normally closed by a circular valve plate 54 superimposed on the plate 50. The valve plate has two segmental openings 56 that, when rotated from the closed position illustrated in FIG. 8, uncover the drain openings 52 in the drain plate 50. The drain plate and valve plate 54 are held together with a stud 58 extending through the centers of two plates and a coil spring 60 on the stud beneath the drain plate 50. The spring is held in place on the stud using a washer 62 and a cotter pin 64.

The valve is held in place in the drain opening in the base of the well using a backing plate 66 extending across the opening inside the shell and two screws 68 through openings in the drain plate 50 into nuts 70 carried on the backing plate. The heads of the screws 68 are located in the openings 56 in the valve plate and act as stops to limit rotation of the valve plate.

As illustrated most particularly in FIG. 9, the drain plate 50 and valve plate 54 have bevelled edges 72 and 74 that mate with corresponding bevelled edges of the drain opening in the well 16.

Figure 7:
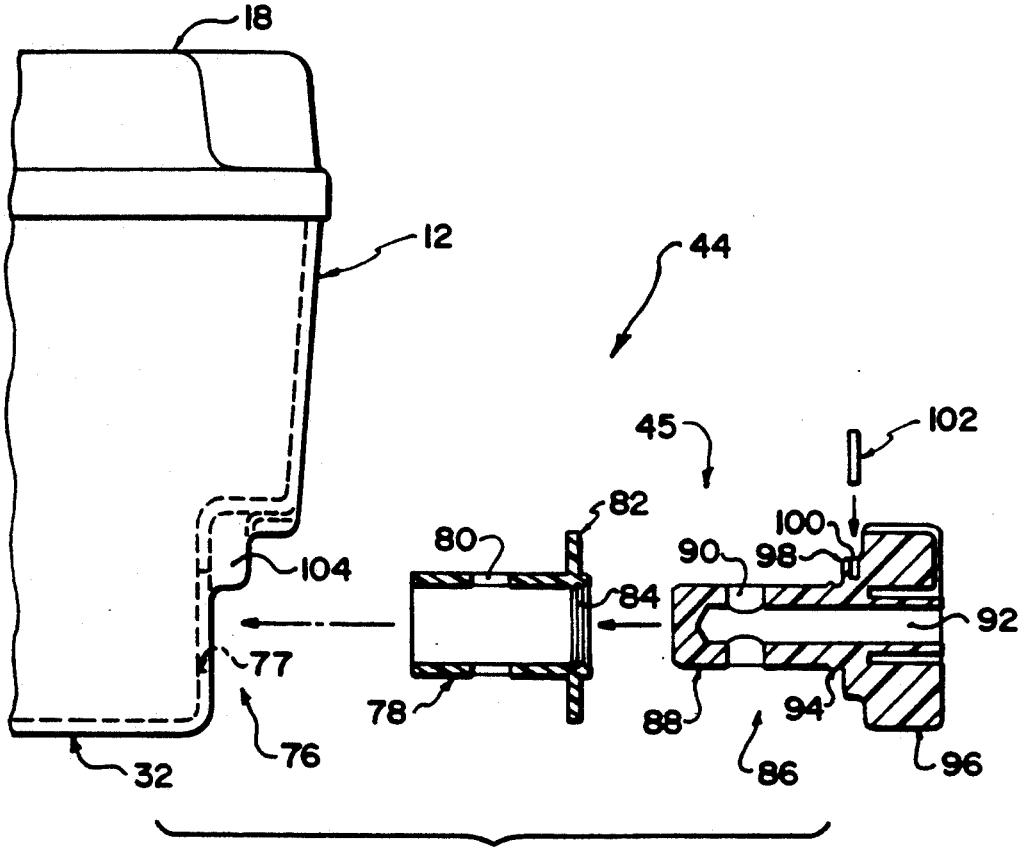
FIG. 7 is an exploded view of a drain valve.

The shell drain 44 is illustrated most particularly in FIG. 7. It includes a recess 76 in the side wall of the shell 12 to accommodate the valve 45. In the base of the recess is an opening 77 that accommodates a valve sleeve 78. The sleeve extends into the opening 77 and has diametrically opposed openings 80 inside the well. A flange 82 on the sleeve adjacent its outer end engages the outer face of the shell within the recess 76 and is secured to the shell to hold the valve in place.

A groove 84 is formed on the inside of the sleeve 78, adjacent its outer end. The sleeve accommodates a valve body 86 having a shaft 88 which extends into and rotates within the sleeve. A cross bore 90 through the shaft 88 communicates with the opening 80 in the sleeve in one orientation of the shaft, while rotation of the shaft in the sleeve closes off this communication to close the valve. An axial bore 92 in the valve body communicates with the cross bore to allow liquid to run through the cross bore and the axial bore to drain the interior shell 12. A circumferential rib 94 on the shaft is a snap fit into the groove 84 in the sleeve 78 to hold these components together.

The valve body 86 has an enlarged head 96 on the outer side. On the inside of the head is a boss 98 of the reduced diameter. This boss has a radial bore 100 that accommodates the end of a radially projecting stop pin 102. The stop pin engages two stops 104 (one shown) molded in to the recess 76 to limit rotation of the valve to a partial rotation between the closed and open position.

It is preferred that the capacity of the unit below the drain 44 is about two and one-half imperial gallons, so that the weight of the unit when full is approximately 30 pounds. In most cases this will be manageable by hand without the use of auxiliary wheels or the like.

In the use of the unit, the rounded top surface of the depression 26 supports the neck, while the long, sloping surface of the support ramp 28 engages a large area of the neck and shoulders to provide a comfortable support for the neck and shoulder area of a patient.

While one particular embodiment of the invention has been described in the foregoing, it is to be understood that other embodiments are possible within the scope of the invention. The invention is to be considered limited solely by the scope of the appended claims.

I claim:

1. A hair washing unit comprising a unitary, hollow shell having a peripheral wall surrounding a well recessed into a top surface of the unit, a U-shaped depression in a front section of the peripheral wall, a shoulder support ramp sloping outwardly away from the front section of the peripheral wall and merging into the depression, and bottle receiving wells in the top surface of the unit, the bottle receiving wells being generally triangular in cross section and sloping upwardly towards the ramp.

2. The unit according to claim 1 including a well drain opening from the well into the hollow shell.

3. The unit according to claim 2 including means for selectively closing the well drain opening.

4. The unit according to claim 3 including shell drain means for draining liquid from within the shell and selectively openable means for closing the shell drain means.

5. The unit according to claim 1 including a hand grip opening through the shell at a leading edge of the ramp.

6. The unit according to claim 1 wherein the shell is moulded from synthetic thermoplastic material.

7. The unit according to claim 1 wherein the shell is linear low-density polyethylene.

8. A hair washing unit comprising a unitary, hollow shell having a peripheral wall surrounding a well recessed into a top surface of the unit, a U-shaped depression in a front portion of the peripheral wall, and a shoulder support ramp sloping outwardly away from the front portion of the peripheral wall and merging into the depression, wherein the unit has a bottom surface including a plurality of steps extending across the unit and facing away from the ramp.

* * * * *